United States Patent [19]

Erben

[11] 4,321,732

[45] Mar. 30, 1982

[54] TUFT FEED CONTROL

[75] Inventor: Ludwig Erben, Monchen-Gladbach, Fed. Rep. of Germany

[73] Assignee: Trützschler GmbH & Co. KG, Monchen-Gladbach, Fed. Rep. of Germany

[21] Appl. No.: 63,113

[22] Filed: Aug. 1, 1979

[30] Foreign Application Priority Data

Aug. 7, 1978 [DE] Fed. Rep. of Germany ..... 2834586

[51] Int. Cl.[3] ..... D01H 5/38

[52] U.S. Cl. ..... 19/240; 19/105

[58] Field of Search ..... 19/240, 105

[56] References Cited

U.S. PATENT DOCUMENTS 4,161,052 7/1979 Erben ..... 19/240

FOREIGN PATENT DOCUMENTS 2658044 6/1978 Fed. Rep. of Germany ..... 19/240

*Primary Examiner*—Louis Rimrodt

*Attorney, Agent, or Firm*—Spencer & Kaye

[57] ABSTRACT

In a fiber tuft feeding apparatus the throughgoing tuft quantities are sensed, signals representing such quantities are emitted and in response to the signals, a tuft quantity metering member, such as a feeding roll is controlled by analog setting signals.

11 Claims, 4 Drawing Figures

TUFT FEED CONTROL

BACKGROUND OF THE INVENTION

This invention relates the regulation of the fiber quantities introduced into a fiber tuft feeding apparatus and concerns, in particular to a pressure-responsive electronic switch that includes an axially adjustable electronic proximity switch, a diaphragm spaced from the proximity switch and positioned in an orientation perpendicular to the axis thereof and a metal plate supporting the diaphragm in a face-to-face relationship therewith. There is further provided a compression spring arranged coaxially about the proximity switch and biasing the metal plate.

In a known electronic pressure-responsive switch of the above-outlined type the compression spring yields as the external pressure which is to be sensed and to which the diaphragm is exposed, increases so that upon reaching a predetermined setting pressure, the metal plate arrives in the switching zone of the electronic proximity switch. Upon this occurrence, a thyristor contained in the proximity switch fires and thus causes a voltage to appear at the output of the pressure-responsive switch. If the external pressure to be sensed drops below a set switching pressure, the thyristor blocks, resulting in a disappearance of the voltage from the output of the pressure-responsive switch.

An electronic pressure-responsive switch of the above-outlined type may constitute a measuring member of a regulating circuit for a fiber tuft feeding apparatus serving a carding machine. Such a regulating circuit comprises a regulator and further, a tuft feeding roll of the feeding apparatus constitutes, a setting member. Such a system, including the above-outlined pressure-responsive switch, is disclosed in U.S. Pat. No. 4,161,052, issued July 17th, 1979.

With a pressure-responsive switch disclosed in the above patent, only a two-point regulation can be obtained. Thus, upon exceeding or falling below a predetermined pressure, the feeding roll is deenergized or energized. Since the conventional electronic proximity switch emits a digital electric signal, the feeding roll cannot be regulated continuously and in a stepless manner.

SUMMARY OF THE INVENTION

It is an object of the invention to provide an improved fiber tuft feeding apparatus, whose fiber quantity measuring member particularly an electronic pressure-responsive switch provides, in a regulating circuit, for a continuous and stepless regulation of the setting member.

This object and others to become apparent as the specification progresses, are accomplished by the invention, according to which, briefly stated, to the setting member analog setting signals are applied as a function of signals emitted by a fiber tuft quantity sensor, particularly an electronic proximity switch responding to tuft quantity-dependent pressure fluctuations.

With the arrangement according to the invention, it is possible to continuously and steplessly regulate the setting member in a regulating circuit.

In a preferred application of the invention, the electronic pressure-responsive switch is used as the measuring member at a feeding shaft of a tuft feeding apparatus for a carding machine for regulating the tuft quantities introduced into the feeding shaft. According to another preferred application of the invention, the electronic pressure-responsive switch constitutes the measuring member arranged at a feeding and distributor conduit of a pneumatic tuft feeding apparatus for regulating the throughput of tuft quantities in the conduit. In this manner it is feasible to regulate the admission of the tufts in the feeding shaft in a stepless manner and as a function of the pressure in the feeding shaft. The tuft stream can thus be continuously and steplessly changed, resulting in a high degree of uniformity of the tuft quantities discharged by the feeding shaft throughout long operational periods.

DESCRIPTION OF THE PREFERRED EMBODIMENTS

Figure 1:
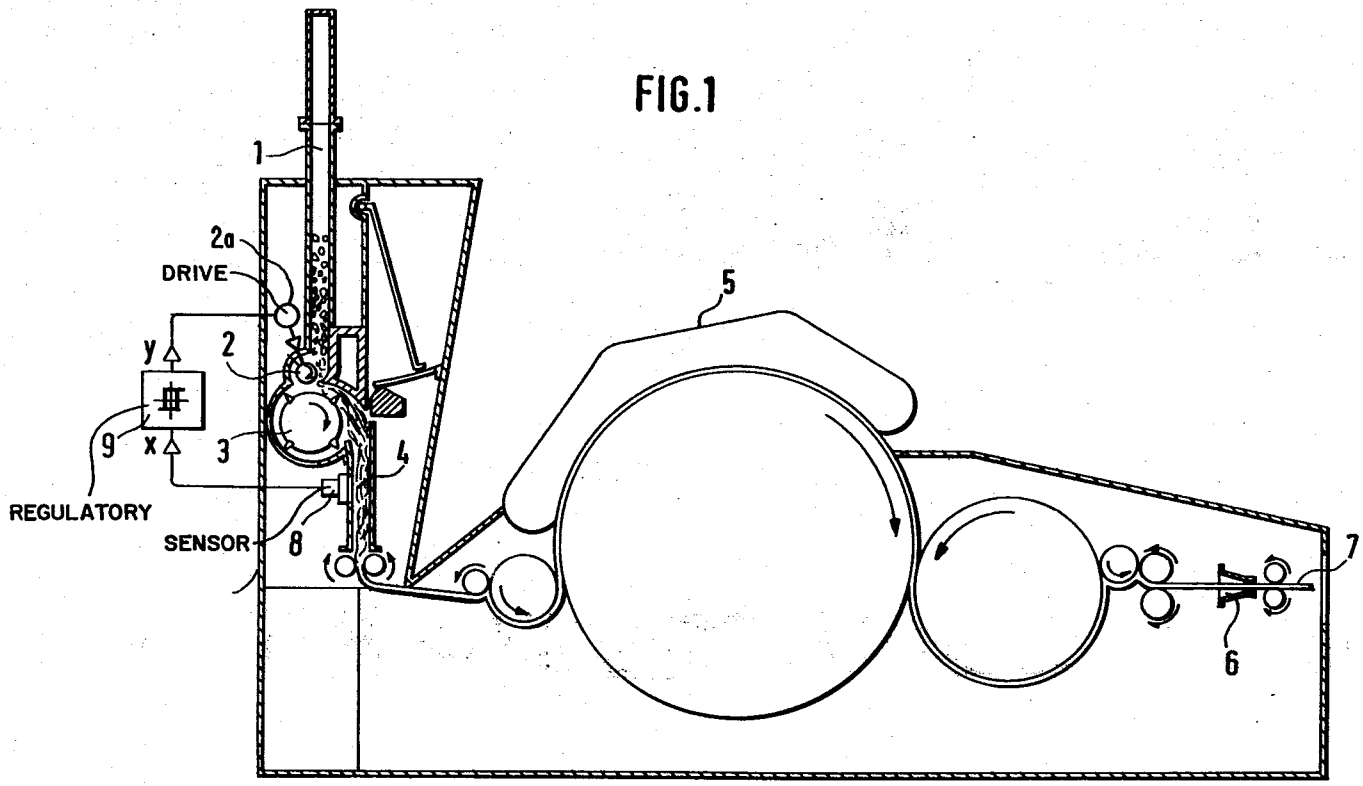
FIG. 1 is a schematic side elevational view of a carding machine and a tuft feeding apparatus, incorporating the invention.

Turning now to FIG. 1, textile fiber tufts are introduced from a fine opening arrangement (not shown) through a feeding and distributor conduit (also not shown) into an upper tuft shaft 1 (material storage shaft). Then a feeding roll 2 and an opening roll 3 forward the tufts to a lower tuft shaft (feeding shaft) 4. The feeding shaft 4 supplies the textile fiber tufts as a fiber web to a carding machine 5. The textile fiber web discharged by the carding machine is gathered into a sliver by means of a sliver trumpet 6.

To a wall of the feeding shaft 4, there is attached an electronic pressure-responsive switch 8 constituting a measuring member. The pressure-responsive switch 8 is connected to a regulator 9 which, in turn, is connected to the drive 2*a* of the feeding roll 2. During operation, the electronic pressure-responsive switch 8 senses the pressure prevailing in the feeding shaft 4. The electronic pressure-responsive switch converts this pressure—in a manner to be described below—into an analog signal x which is applied to the regulator 9. The latter, in response, generates a setting signal y which is applied to the drive 2*a* of the feeding roll 2. By varying the rpm of the feeding roll 2 as a function of the pressure fluctuations in the feeding shaft 4, there is effected a continuous alteration of the tuft quantities in the feeding shaft 4.

Figure 2:
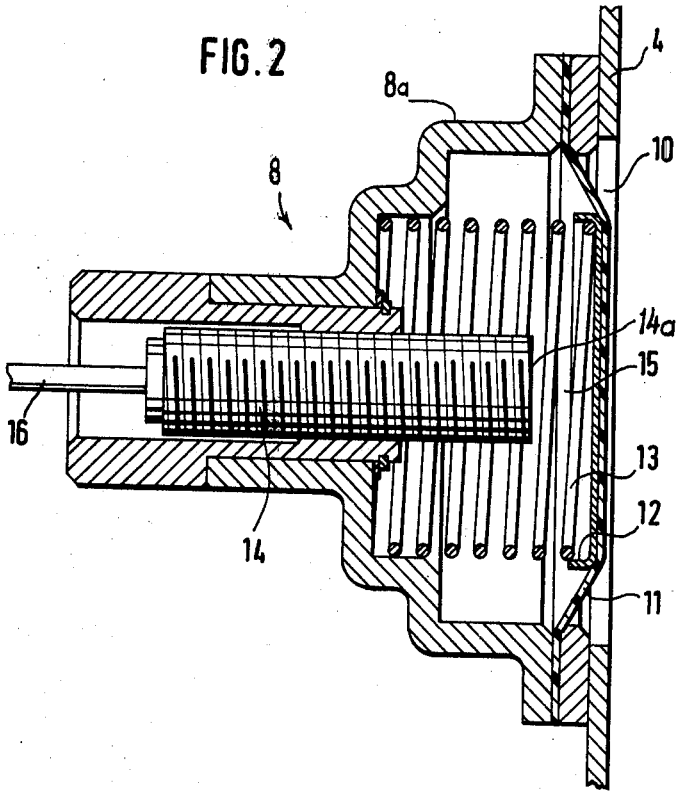
FIG. 2 is an axial sectional view of a preferred embodiment of the electronic pressure-responsive switch according to the invention.

The electronic pressure-responsive switch 8, which in principle, is provided to convert pressure fluctuations into electrical signals, may include, for example, known piezoelectric crystal elements. This conversion may also be effected by means of known elements, such as a slide resistor, resistance strain gauge, capacitor or light barrier. As seen in FIG. 2, signals x leave the electronic proximity switch 14 which is part of the pressure-sensitive switch 8, rather than the regulator 9. Thus the signals x cannot be applied directly to the drive of the feeding roll 2; they must be fed into the regulator 9 (switchboard with switching relays or equivalent electrical or electronic elements) where they are processed into a further pulse train y which acts on the motor of the feeding roll 2. The pressure-responsive switch 8 will now be described in more detail with reference to FIG. 2.

In a wall portion of the feeding shaft 4, there is provided an opening 10 which is closed by a diaphragm 11 of the electronic pressure-responsive switch 8. The diaphragm 11 which may be an elastomer, is clamped into a switch housing 8*a* and is, on its face oriented away from the feeding shaft 4, supported by a metal plate 12.

The housing 8*a* further accommodates an analog signal-emitting electronic proximity switch 14 which may be the commercially available model IA-4010-D "efector" manufactured by IFM Electronic of Essen, Federal Republic of Germany. The electronic proximity switch 14 is, along a part of its length, surrounded by a coil spring 13, whose one end engages a bottom part of the housing 8*a*, while its other end engages the metal support plate 12. A clearance 15 is provided between an end 14*a* of the electronic proximity switch 14 and the metal plate 12. The clearance 15 is adjustable by changing the axial position of the proximity switch 14 by virtue of its threaded connection with the housing 8*a*. The other, opposite end of the electronic proximity switch 14 is connected with the regulator 9 (FIG. 1) by means of a conductor 16.

The electronic pressure-responsive switch 8 is adapted to measure the pressure prevailing in the feeding shaft 4 in a range from 0 to 150 mm WS. Pressure fluctuations in this range are converted by the electronic proximity switch 14 into the continuous analog signal x as a function of the pressure-dependent distance of the metal plate 12 from the end 14*a* of the electronic proximity switch 14. In the range between 50 and 150 mm WS, the output signal x of the electronic proximity switch 14 is linearly proportionate to the pressure in the feeding shaft 4.

Figure 3A:
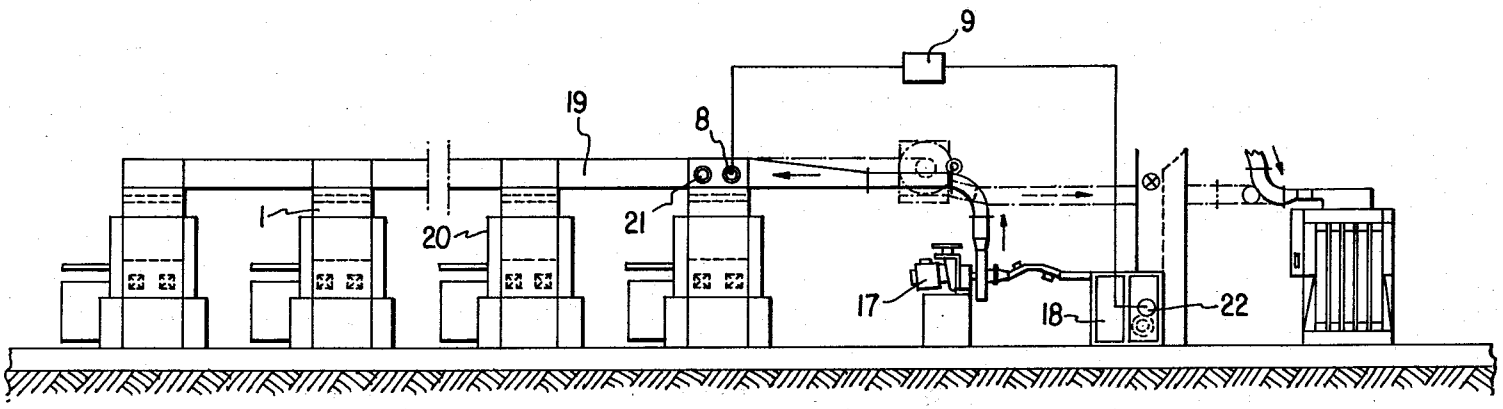
FIG. 3*a* is a schematic side elevational view of a tuft feeding installation incorporating the invention.
Figure 3B:
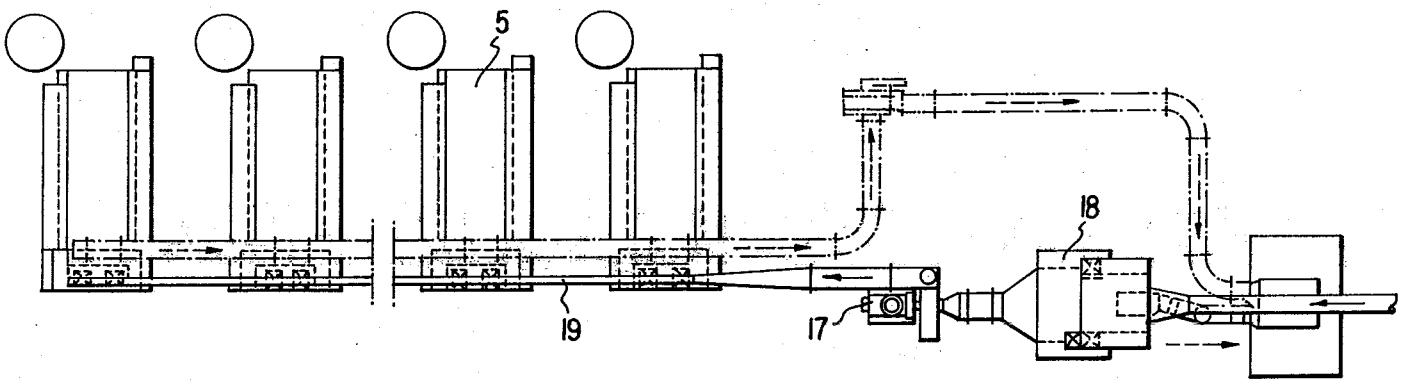
FIG. 3*b* is a top plan view of the structure shown in FIG. 3*a*.

FIG. 3*a* is an elevational view and FIG. 3*b* is a plan view of a tuft feeding installation. A transport blower 17 has its suction side connected to a fine opener 18. The suction pipe of the transport blower 17 is connected to a feeding and distributing conduit 19 which extends above card feeders 20 and to which are connected the reserve shafts 1. Above the first reserve shaft 1, the electronic pressure-responsive switch 8 is attached to the distributing conduit 19.

The transport blower 17 sucks the opened fiber material from the last beater position of the opening system—e.g. the fine opener 18—and conveys it in a stream of transporting air through the feeding and distributing conduit 19 to the reserve shafts 1 of the connected card feeders 20.

When the mixture of tufts and air enters the reserve shafts 1, the air escapes through the transporting air discharge filters (not shown) and the tufts are deposited in the reserve shafts 1 where the columns of material develop.

This increase in pressure continues with increasing fill level of the reserve shafts 1.

To the beginning of the distributing conduit 19, above the first reserve shaft 1, there is connected a fine pressure gauge 21 to indicate the pressure in mm column of water and the electronic pressure-responsive switch 8 to control the supply of material from the fine opener 18 to the transport blower 17.

In this way, more or less fiber material reaches the transport blower 17. The transport blower 17 continues to operate and conveys fiber material and air into the feeding and distributing conduit 19 and maintains the pressure conditions.

The electronic pressure-responsive switch 8 is connected with an electric drive motor 22 with the intermediary of a regulator 9 which may include a time relay. By means of an infinitely variable gear system (not shown), the drive motor 22 drives an opening roll (not shown), e.g. Kirschner wings, in the fine opener 18. In the described embodiments, the electronic pressure-responsive switch 8 acts on the feeding roll 2 or the fine opener 18, respectively. It may also affect, however, further setting members with which the quantity of tufts to be transported is varied.

The electronic pressure-responsive switch 8 may be used with every tuft feeding system (chute feeding system) for textile machines. It can also be used with a "pneumafeeder", that is, a box feeder for beater machines.

It is to be understood that the above description of the present invention is susceptible to various modifications, changes and adaptations, and the same are intended to be comprehended within the meaning and range of equivalents of the appended claims.

What is claimed is:

1. In an apparatus for regulating fiber tuft quantities introduced from a tuft feeding means into a carding machine; said tuft feeding means including a conduit through which the tufts pass and advancing means arranged in said conduit for forwarding the fiber tufts into the carding machine; the improvement comprising:

(a) pressure sensing means connected to said conduit downstream of said advancing means, as viewed in the direction of tuft feed, for generating pressure signals representing the pressure in said conduit;

(b) signal converting means for changing said pressure signals into analog electric signals; and (c) regulating means connected to said signal converting means and said advancing means for receiving said analog electric signals from said signal converting means and for applying continuous setting signals to said advancing means as a function of said analog electric signals to continuously and steplessly control the feed of the fiber tuft quantities to said carding machine as a function of the pressure in said conduit.

2. An apparatus as defined in claim 1, wherein said conduit is a tuft feeding shaft of a tuft feeding device for the carding machine; and further wherein said advancing means comprises a feeding roll situated in said tuft feeding shaft at the upstream end thereof as viewed in the direction of tuft feed.

3. An apparatus as defined in claim 1, wherein said tuft feeding means is a pneumatic tuft feeding installation and said conduit forms part of a supply and distributor conduit system of said installation and further wherein said advancing means is connected to said installation at the upstream end thereof as viewed in the direction of tuft feed.

4. An apparatus as defined in claim 1, wherein said conduit has a wall and further wherein said pressure sensing means and said signal converting means are constituted by a pressure-responsive switch being mounted on said wall and having an output connected to said regulating means.

5. An apparatus as defined in claim 4, wherein said pressure-responsive switch comprises:

(a) a housing;

(b) a diaphragm clamped in said housing and having inner and outer faces; said outer face being arranged for exposure to the pressure to be sensed;

(c) a metal plate arranged in a face-to-face contacting relationship with said inner face of said diaphragm for moving with said diaphragm as a unit in response to pressure variations affecting said outer face of said diaphragm;

(d) a spring accommodated in said housing and biasing said diaphragm in a direction outwardly of said housing; and (e) an electronic proximity switch means for emitting said analog signal dependent upon the position of said metal plate; said electronic proximity switch means comprising a body having a longitudinal axis and an end; said body being oriented such that said axis is generally perpendicular to a main plane of said diaphragm and said end is facing said metal plate and is at a distance therefrom.

6. An apparatus as defined in claim 4, wherein said pressure-responsive switch includes piezoelectric crystal elements.

7. An apparatus as defined in claim 4, wherein said pressure-sensitive switch includes a variable slide resistor.

8. An apparatus as defined in claim 4, wherein said pressure-sensitive switch includes a resistance strain gauge.

9. An apparatus as defined in claim 4, wherein said pressure-sensitive switch includes a capacitor.

10. An apparatus as defined in claim 4, wherein said pressure-sensitive switch includes a light barrier.

11. In an apparatus for regulating fiber tuft quantities introduced from a tuft feeding means into a carding machine; said tuft feeding means including a tuft feeding shaft through which the tufts pass, a feeding roll arranged in said tuft feeding shaft for forwarding the fiber tufts into the carding machine and a drive connected to said feeding roll for rotating said feeding roll; the improvement comprising:

(a) a tuft quantity sensing means in said tuft feeding shaft downstream of said feeding roll, as viewed in the direction of tuft feed, for generating first signals representing the tuft quantities in said tuft feeding shaft;

(b) signal converting means for changing said first signals into analog electric second signals; and (c) regulating means connected to said signal converting means and said drive for receiving said second signals from said signal converting means and for applying continuous setting signals to said drive as a function of said second signals to continuously and steplessly control the feed of the fiber tuft quantities to said carding machine as a function of the tuft quantities in said tuft feeding shaft.

* * * * *